US005142327A

United States Patent [19]

Kahle

[11] Patent Number: 5,142,327

[45] Date of Patent: Aug. 25, 1992

[54] ELECTROPHOTOGRAPHIC COPYING PROCESS USING TWO IMAGE AREAS

[75] Inventor: Todd A. Kahle, Hartford, Wis.

[73] Assignee: Infographix, Inc., Sussex, Wis.

[21] Appl. No.: 682,782

[22] Filed: Apr. 9, 1991

[51] Int. Cl.[5] ..... G03G 15/00

[52] U.S. Cl. ..... 355/210; 355/212; 355/270

[58] Field of Search ..... 355/270, 269, 212, 296, 355/219, 210

[56] References Cited

U.S. PATENT DOCUMENTS

| | | | |
|---|---|---|---|
| 4,129,072 | 12/1978 | Fujii et al. | 355/269 |
| 4,386,577 | 7/1983 | Hosono et al. | 118/657 |
| 4,391,512 | 7/1983 | Nakamura et al. | 355/251 X |
| 4,396,275 | 8/1983 | Oka et al. | 355/212 |
| 4,403,851 | 9/1983 | Yanagawa | 355/212 |
| 4,465,360 | 8/1984 | Yamagishi et al. | 355/270 X |
| 4,488,802 | 12/1984 | Sunaga et al. | 355/270 |
| 4,547,064 | 10/1985 | Ammenheuser et al. | 355/270 X |
| 4,616,922 | 10/1986 | Sobieski et al. | 355/270 |
| 4,652,114 | 3/1987 | Sobieski et al. | 355/296 X |

*Primary Examiner*—A. T. Grimley
*Assistant Examiner*—Robert Beatty
*Attorney, Agent, or Firm*—Quarles & Brady

[57] ABSTRACT

An electrophotographic copier includes a transfer/charge section, a developer/cleaner section, and a photoreceptor having a surface with first and second image areas. Copies are produced by moving the photoreceptor a half revolution so that the first image area passes through the transfer/charge section in which a uniform charge is applied to the first image area. The charged first image area is exposed to a light image producing an electrostatic image on a surface of the photoreceptor. Toner is applied to the exposed first image area as it passes through the developer/cleaner section. The toned image is transferred to paper by moving the first image area through the transfer/charge section, after which the toner is fused onto the paper. When an another copy is to be made, the second image area passes through the transfer/charge section to apply a uniform charge to that image area while the developer/cleaner section removes residual toner from the first image area. Then the second image area is used to produce the next copy. Otherwise the transfer/charge section is not activated and only the residual toner is removed from the first image area before the copying process ends.

8 Claims, 4 Drawing Sheets

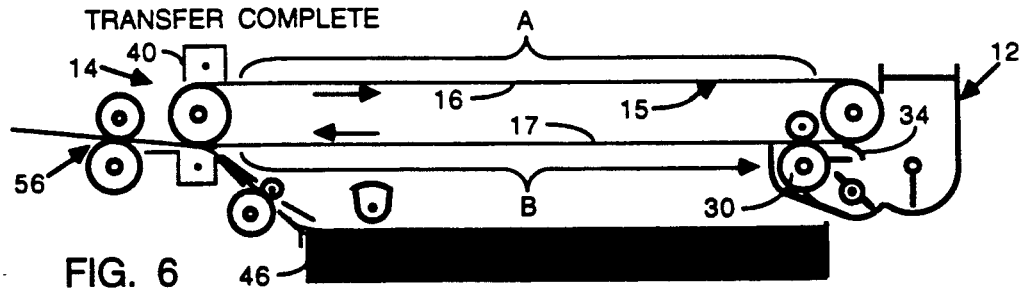
FIG. 6
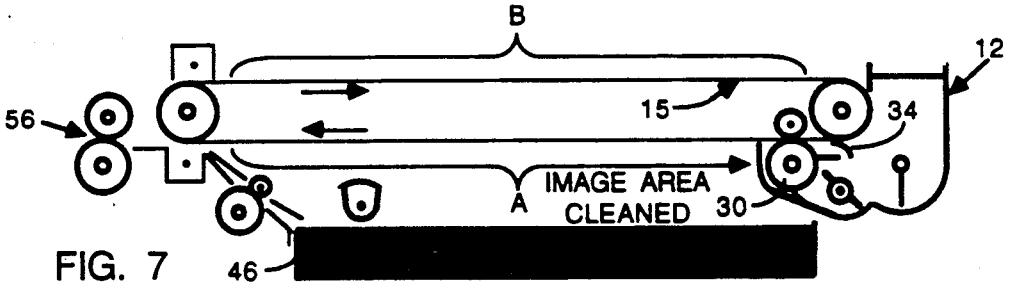
FIG. 7
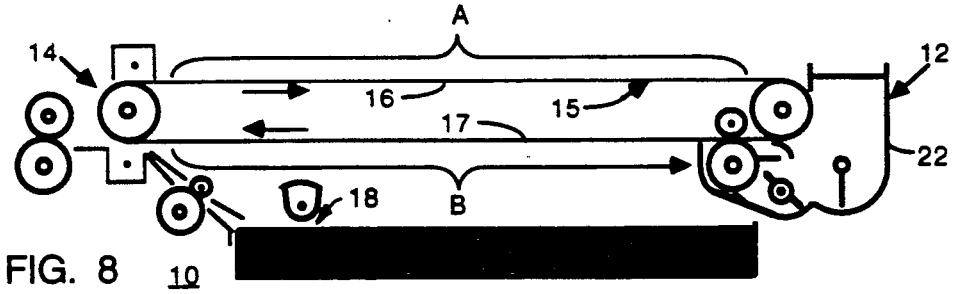
FIG. 8
| A | B | A | B | A | B | A | B |
|---|---|---|---|---|---|---|---|
| CHARGE | | DEVELOP | | TRANS-FER | | CLEAN | |
| FIRST HALF REVOLUTION | | SECOND HALF REVOLUTION | | THIRD HALF REVOLUTION | | FOURTH HALF REVOLUTION | |
FIG. 9

ELECTROPHOTOGRAPHIC COPYING PROCESS USING TWO IMAGE AREAS

BACKGROUND OF THE INVENTION

The present invention relates to an electrophotographic copying process; and more particularly to such a process for obtaining paper copies of documents recorded on microfilm.

Electrophotographic processes for producing a permanent image on plain paper are well known and commonly used in office copiers, laser printers and microfilm viewer/printers. In general, all these processes include: (1) charging a photoreceptor which is a drum or continuous belt bearing a photoconductive material; (2) exposing the charged area to a light image to produce an electrostatic charge image; (3) applying developer particles (toner) to the photoreceptor surface bearing the image to form a visible image; (4) transferring the particles in the form of the image from the photoreceptor to paper; (5) fusing or fixing the transferred particles to the paper; and (6) cleaning or restoring the photoreceptor for the next printing cycle. Further information about electrophotographic processes is available in the text "The Physics and Technology of Xerographic Processes", by Edgar M. Williams, 1984, a Wiley-Interscience Publication of John Wiley & Sons, the disclosure of which is hereby incorporated by reference.

Due to the curved surface of a photoreceptor drum, an image must be formed in sections on that surface by scanning the object being reproduced. The object scanning has to be synchronized with the movement of the drum, thereby adding to the complexity of the copier. The complexity rises even more when image scan projection is employed in a microfilm viewer/printer. Although the magnification ratio for copy machines typically is no greater that 2 to 1, the magnification required in microfilm viewer/printer ranges from 12 to 1 all the way up to 72 to 1. This increased magnification necessitates extremely consistent movement of the scanning system to avoid blurring the reproduced image. In addition, a scanning system increases the size of both types of reproduction apparatus.

An alternative approach to image scanning, referred to as "full plane exposure," projects the entire image onto a portion of the photoreceptor belt surface that has been stretched flat. U.S. Pat. No. 4,616,922 describes a microfilm viewer/printer that uses full plane exposure of a photoreceptor belt. That system addresses the problems associated with image scanning, but does not adequately address the problem of apparatus size. The loop of the photoreceptor belt has to be long enough so that the individual devices that perform separate steps of the copying process can be located around the perimeter of the belt. Furthermore enough clear space must be provided between the charging and the developing devices as well as between the developing and transfer devices so that a portion of the belt containing an image can be parked in both those locations during the processing.

While it is desirable to utilize full plane photoreceptor exposure in electrophotographic equipment, reducing the size of such equipment still needs to be addressed.

SUMMARY OF THE INVENTION

An electrophotographic copier has a photoreceptor with separate first and second image areas for producing copies on plain paper or other media. During the reproduction process, a uniform electrical charge is applied to the first image area which is then exposed to a light image, thereby replicating the light image as an electrostatic image on the photoreceptor. Toner is applied to the exposed first image area of the photoreceptor. Then charged paper is brought into contact with the first image area to transfer toned image onto the paper. The paper is heated to fuse the toner onto the paper.

Thereafter residual toner is removed from the first image area coincident with the second image area being treated with a uniform charge. The charged second image area is exposed to another light image thereby producing an electrostatic image in the second image area. Toner is applied to the second image area of the photoreceptor, which toner then is transferred and fused onto the paper.

When more copies are desired, the first image area is then uniformly charged, while residual toner is being removed from the second image area. The process steps of exposure, developing and transfer are repeated again for the newly charged first image area. Otherwise, if further copies are not required, the residual toner merely is cleaned from the second image area and the processing terminates.

An object of the present invention is to provide a plain paper electrophotographic copying process which utilizes full plane exposure.

Another object is to implement that electrophotographic process in a compact copying apparatus.

A further object of the present invention is to provide a copying method in which a step for processing one image is performed coincident with a step for processing another image.

BRIEF DESCRIPTION OF THE DRAWINGS

FIGS. 2-8 sequentially illustrate the apparatus in FIG. 1 at different steps in the copying process;

FIG. 9 schematically depicts the steps of a single copy production mode that occur during each half revolution of the photoreceptor belt in FIG. 1.

DETAILED DESCRIPTION OF THE INVENTION

Figure 1:
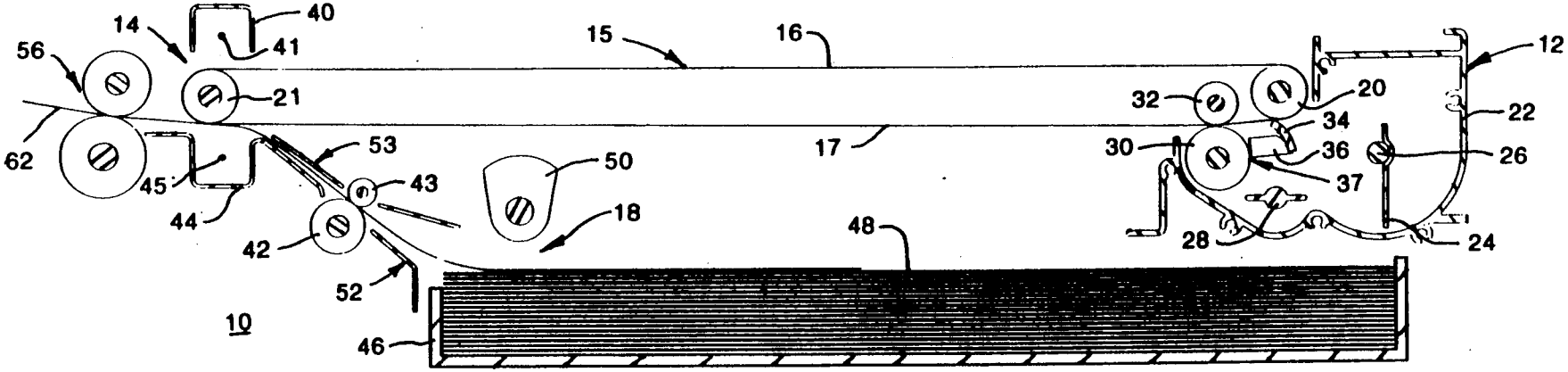
FIG. 1 is a cross-sectional view of an electrophotographic copying apparatus according to the present invention.

FIG. 1 illustrates a printer mechanism 10 of an electrophotographic copying apparatus including a developer/cleaning section 12, a transfer and charging section 14, a photoreceptor belt 15 and a paper handling section 18. Although this mechanism will be described as part of a viewer/printer for microfilm, the present invention can be applied to other types of electrophotographic equipment, such as copying machines and laser printers.

The photoreceptor belt 15 comprises an aluminized polyester film substrate coated with an organic or inorganic photoconductive material, as is well known in the copying art. The circumference of the continuous loop photoreceptor belt 15 is at least twice the length of the image to be produced on a sheet of paper. The width of the belt 15 is slightly greater than the width of that image, although the image could be rotated ninety degrees with respect to the belt. The belt is stretched around two rollers 20 and 21 that are adjacent the developer/cleaner section 12 and the transfer/charge section 14, respectively, thereby forming upper and lower belt portions 16 and 17.

The transfer/charge section 14 includes a belt charging corona unit 40 above the second belt roller 21. The belt charging corona unit 40 has a wire 41 extending across the full width of the belt 15. In the belt charging phase this wire 41 is biased at negative five kilovolts, for example, and imparts a negative charge to the outer surface of the belt as it comes off of the second belt roller 21. During other phases of operation, the wire 41 of the belt charging corona unit 40 is not biased. The transfer/charge section 14 also includes an image transfer corona unit 44 with another wire 45 extending across the width of the belt. When an image is being transferred onto paper, this other wire 45 is biased at +4.75 kilovolts, for example, to positively charge the paper. At other times, a bias voltage is not applied to wire 45 of the image transfer corona unit 44.

At the other end of the belt loop is the developer/-cleaner section 12, which has a design similar to the one described in U.S. patent application Ser. No. 07/627,678 entitled "Electrostatic Image Developer Dispenser". The developer/ cleaner section 12 has a toner reservoir 22 that is slightly wider than the photoreceptor belt 15. Preferably, a standard monocomponent toner is used in the present printer mechanism 10. Such toner consists of particles having a metal core coated with a plastic material that is pigmented with carbon black. For simplicity, the toner has not been illustrated within the reservoir 22. A primary paddle 24 is mounted on a shaft 26 within the toner reservoir 22 and extends across the width of the reservoir. An elongated submixing paddle 28 is positioned parallel to shaft 26. A conventional toner conveyor 30 with internal permanent magnets is positioned across the reservoir 22 and is spaced from the photoreceptor belt 15. The two paddles 24 and 28 urge the toner against the conveyor 30, and a doctor blade 36 insures that the conveyor surface is coated with a uniform layer of toner particles. The movement of the toner particles against the conveyor and the doctor blade impacts a negative charge onto a layer of the toner particles passing through a gap 37 between the conveyor and doctor blade.

The photoreceptor belt 15 revolves in a clockwise direction around the rollers 20 and 21, one of which is driven to move the belt. The conveyor 30 is driven counter-clockwise bringing the layer of toner on its surface into contact with the outer surface of the photoreceptor belt 15. An idler roller 32, within the loop of the photoreceptor belt 15, maintains the spacing between the belt and the conveyor 30 substantially equal to the thickness of the layer of toner.

The developer/cleaner section 12 also includes a resilient cleaning blade 34 positioned between the belt charging corona unit 40 and the conveyor 30. The cleaning blade wipes against the outer surface of the belt 15 to remove any residual toner from that surface and return the toner to reservoir 22. It has been determined that the cleaning blade 34 can be in constant contact with the belt without adversely affecting an electrostatic charge or an electrostatic image on the belt.

The paper handling section 18 has a paper tray 46 containing a stack of paper sheets 48, and a paper feeder 50 above the tray. When the paper feeder 50 rotates in a clockwise direction, the top sheet of paper 62 is fed off the stack to the left and into a first deflector 52 which guides the paper toward and between a pair of abutting rollers 42 and 43. The lower one of these rollers 42 is driven against the other one 43 drawing the paper sheet from the tray 46 and pushing it through a second deflector 53 toward the image transfer corona unit 44. As will be described, the sheet of paper 62 then travels across the transfer corona unit 44 and into contact with the photoreceptor belt 15. The paper continues to travel through a fuser unit 56 having a roller heated to approximately 380 degrees Fahrenheit. The functions performed by the components of the printer mechanism 10 will be better understood by describing the copying operation.

Figure 2:
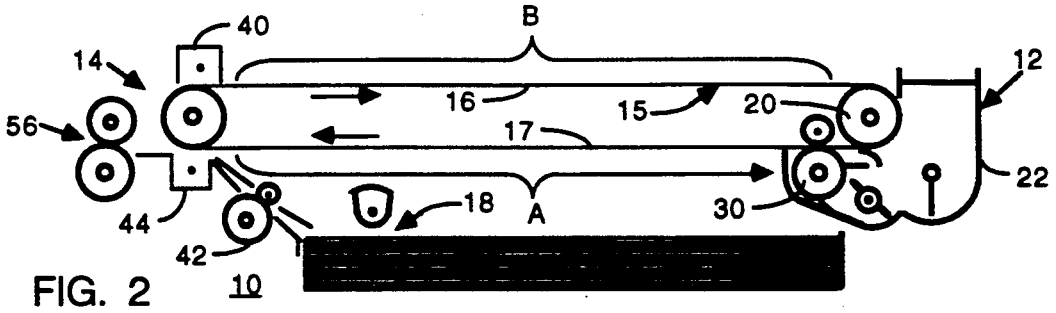

FIG. 2 shows an initial position of the printer mechanism 10 prior to the user initiating a copying operation. In this position, a first image area A on,.the photoreceptor belt 15 is located on the lower portion 17 and a second image area B is located on the upper portion 16. First consider the steps that are performed to make a single copy. When the copying sequence is initiated, belt roller 20 is turned by a motor and drive assembly (not shown) moving the belt 15 in the clockwise direction. As the first image area A leaves the top of the second roller 21, it passes beneath the activated belt charging corona unit 40 which imparts a uniform negative charge onto the photoreceptor belt surface comprising image area A. The belt 15 travels one-half revolution ultimately reaching a position shown in FIG. 3 where image area A is now on the top side of the belt where it faces the optics of the microfilm imaging apparatus. The steps of the copying process to make a single copy correspond to half revolutions of the photoreceptor belt 15, which are depicted in FIG. 9. As illustrated for the first half revolution, image area A has been charged while nothing happens with respect to image area B.

Figure 3:
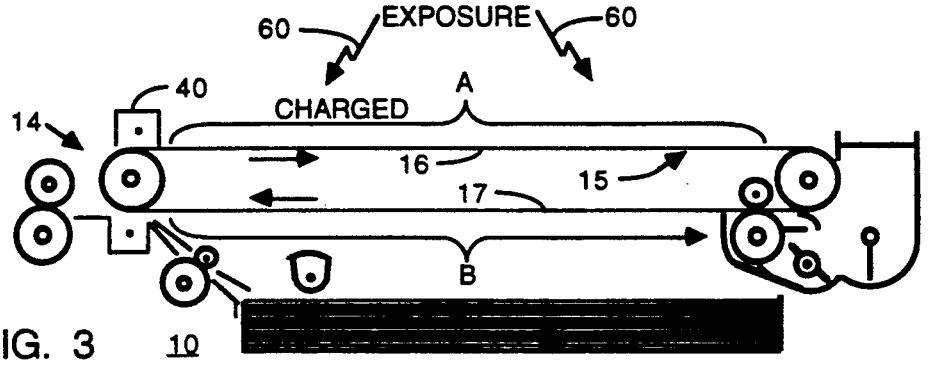

The movement of the photoreceptor belt 15 is halted temporarily in the position shown in FIG. 3 and the optical system is activated to expose image area A to the light image, as represented by a pair of lines 60. It should be noted that when the belt 15 is stopped for the exposure of image area A, a portion of image are B is stopped within the developer/cleaner section 12. In a microfilm viewer/printer, a mirror assembly moves to redirect the light from a projection lamp away from the viewing screen and onto the photoreceptor.

As is well known, the photoconductive material on belt 15 operates to accept a negative static electrical charge from corona unit 40 and retains this charge on its surface. The regions of photoconductive material struck by light become conductive allowing the surface charges to flow to the conductive substrate of the belt 15 where they are removed leaving modified charge regions where light struck the belt. The present printer mechanism 10 is particularly adapted for use in a microfilm viewer/printer in which the microfilm is transparent in its informational area. Thus a light image corresponding to the information contained on the microfilm is applied to the photoreceptor belt 15. Since light causes the photoconductive material on the belt 15 to become conductive, those areas become neutrally charged, surrounded by negative surface charges where the information carried by the light was not applied to the belt. Therefore, an electrostatic image is replicated onto the image area A of the belt 15.

Figure 4:
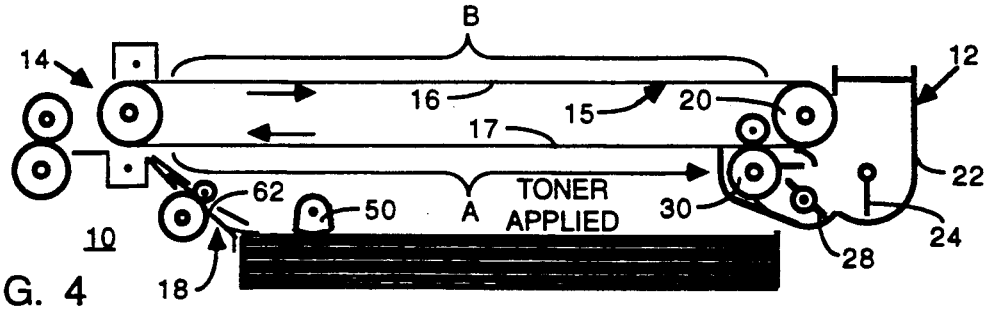

After exposure, the photoreceptor belt 15 moves clockwise a second half revolution through the developer/cleaner section 12 to a position shown in FIG. 4, however the belt does not stop in this position. Although the cleaning blade 34 brushes against the exposed area of the belt, the electrostatic image is not significantly affected. At this time, a negative bias is applied to the conveyor 30 to induce a positive charge in the neutral regions of the belt caused by the light exposure. When the image area A of the belt comes into contact with the layer of toner on the conveyor 30, the negatively charged toner particles transfer to the regions of image area A where light struck, and are repelled from the negatively charged regions where light did not strike. Thus, the toner is attracted to the informational areas of the photoreceptor belt 15.

Figure 5:
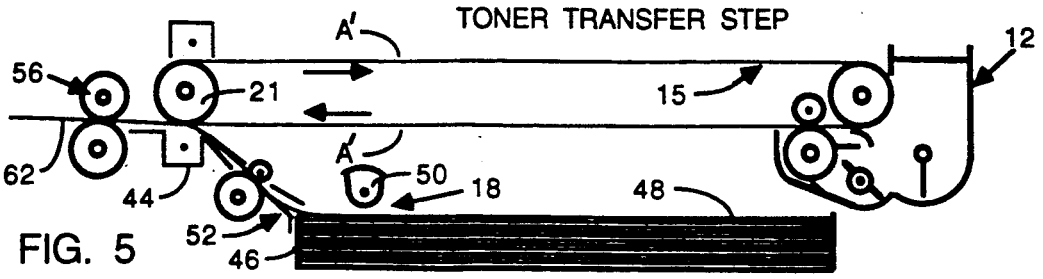

Slightly before, the belt 15 reaches the position shown in FIG. 4, the paper handling section 18 is activated causing the paper feeder 50 to push the top sheet 62 of paper from the tray 46 and into the first deflector 52. With reference to FIG. 5, the paper rollers 42 and 43 force the paper over the now activated transfer corona unit 44 to impart a positive charge on the underside of the sheet 62. The sheet travelling in an upward direction is forced against the outer surface of the photoreceptor belt 15. The paper handling section 18 is synchronized with the belt movement so that the leading edge of paper sheet 62 contacts the belt 15 in registration with the leading edge of image area A.

Since the underside of the paper sheet 62 has a positive static charge, the negatively charged toner particles are attracted from the receptor belt 15 to the paper, thereby transferring the image to the paper. As the belt passes around the second roller 21 the paper sheet 62 separates from the belt and enters the fuser unit 56 which heats the paper to about 380 degrees Fahrenheit. This temperature causes the toner to melt and fuse onto the paper sheet 62. The paper then flows out of the fuser unit 56 and into a suitable receptacle for the finished copies.

The photoreceptor belt 15 continues to travel after the ejection of the paper into a position shown in FIG. 6 at which image area A is on the upper portion 16 of the belt loop. It should be noted that corona unit 40 is not energized during the transfer step. Image area A contains residual particles of toner which were not transferred onto the paper. These residual particles must be removed before image area A can be exposed to a new image, as the particles interfere with the application of a uniform charge to the surface of the receptor belt. From this point, the belt is moved another half revolution during which image area A comes into contact with the cleaning blade 34 which removes the residual toner from that portion of the belt. In this step, toner is not imparted onto the belt 15 as it passes against the conveyor 30 since the belt essentially has a neutral charge and the conveyor is not negatively biased during this half revolution of the belt. As a result when the belt 15 reaches a position illustrated in FIG. 7, image area A on the lower portion 17 of the belt is clean and ready for another image. The single copy mode now terminates and the belt stops revolving being positioned as it was in FIG. 1 prior to the commencement of the copying process.

Therefore, in the single copying mode, only one image area is utilized to make the copy and two revolutions of the photoreceptor belt 15 occur during each copying operation. The only time that the photoreceptor belt 15 stops moving between the positions illustrated in FIGS. 2–7 is when the image area in exposed to light in FIG. 3.

Figure 10A:
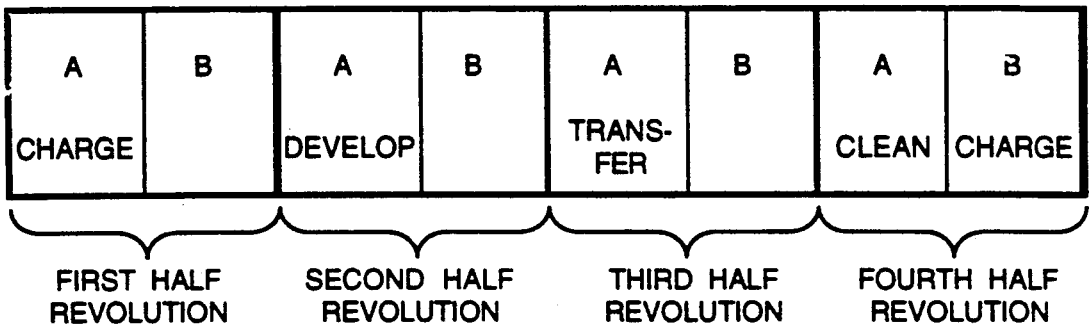
FIGS. 10A and 10B schematically depict the steps of a multiple copy production mode that occur during each half revolution of the photoreceptor belt.

The printer mechanism 10 can be used to produce multiple copies of the same original in one operation. When the print mechanism is placed in the multiple copy mode, the sequence of steps for each copy is the same as in the single copy mode, except that both image areas A and B are used to make copies. The process steps that occur during each half revolution of the photoreceptor belt 15 in the multiple copy mode are shown beginning in FIG. 10A. The following description assumes that the belt starts from the position illustrated in FIG. 2 when the multiple copying operation commences. During the first half revolution, image area A is charged by corona unit 40, while nothing occurs with respect to image area B.

At the end of this half revolution, the belt 15 stops temporarily in the position illustrated in FIG. 3 where image area A is exposed to the light image to replicate that image as a electrostatic charge pattern on that section of the belt. After the exposure interval the belt is moved clockwise again. During the second half revolution which occurs between the positions indicated in FIGS. 3 and 4, the electrostatic pattern on image area A is developed by applying toner as it passes through the developer/cleaner section 12. Although image area B is in a position in FIG. 4 where it could be exposed to a light image for the next copy, part of image area A is within the developer/cleaner section 12. If the belt was stopped at this point, the part of the image in area A that is in contact with the conveyor 30 could be smudged by the intermittent movement of the conveyor. Thus image area B can not be exposed at this time.

During the third half revolution, a sheet of paper is fed from the paper tray 46 into contact with the first image area A to transfer the toned image onto the paper as shown in FIG. 5. At the end of the third half revolution, the photoreceptor belt 15 is in the position depicted in FIG. 6 where image area A is on the upper portion 16 and has residual toner from the transfer operation.

The fourth half revolution then commences in which image area A passes through the developer/cleaner section 12 to remove the residual toner from the belt. The cleansing process is the same as described above for the single copy mode. During this half revolution, image area B passes beneath the activated belt charging corona unit 40 and has a uniform negative electrostatic charge imparted on it. At the completion of this half revolution, the belt is positioned as illustrated in FIG. 7 with charged image area B on the upper portion 16 and a clean image area A on the lower portion 17. Thus the positions and states of the two image areas are reversed from those shown in FIG. 3. At this time image area B is exposed to the light image for the next copy, followed by the development, transfer and cleaning steps during the fifth through seventh half revolutions of the belt 15 as depicted in FIG. 10B.

If only two copies are being made, nothing occurs to image area A during the seventh half revolution at which time image area B is cleaned in the developer/cleaner section 12. At the completion of the seventh half revolution, the belt is in the position indicated in FIG. 8 where image area A is on the upper portion 16 of the loop and image area B is on its lower portion 17. At this point, the copying operation is complete and the belt stops revolving to await the next copying operation. It should be noted that, since image area B is positioned on the underside of the belt, it will be utilized first when the next copying operation commences.

Figure 10B:
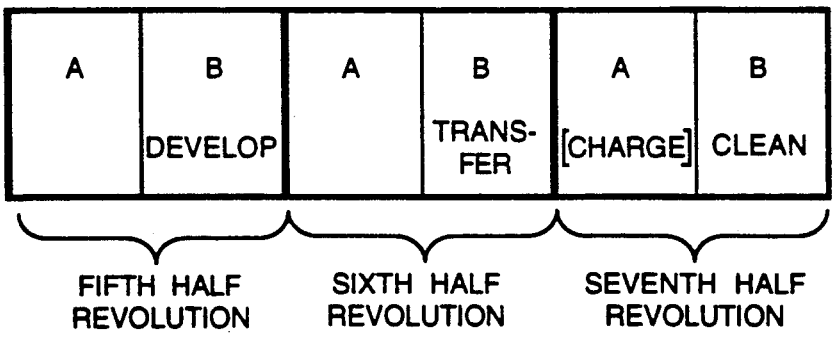

However, if another copy is to be made at the completion of the sixth revolution, a charge is imparted onto image area A while the image area B is being cleaned during the seventh revolution, as indicated by the parentheses around the word charge in FIG. 10B. Furthermore, at the completion of the seventh half revolution, the photoreceptor belt 15 is stopped temporarily in the position indicated in FIG. 8 to expose image area A and continue the copying process. Thereafter, the process continues by performing the development, transfer and cleaning steps with respect to image area A.

Image areas A and B are alternately employed to make copies, in the multiple copy mode. When the last copy is ejected from the printer mechanism 10, the photoreceptor belt 15 makes one final half revolution to clean the residual toner from the image area which produced the last copy.

It is important that the photoreceptor belt 15 be fully cleaned at the completion of each copying operation regardless of whether single or multiple copies were produced. Failure to properly clean the belt allows the residual toner from the copying operation to remain on the belt where it may come into contact with the operator's skin or clothing during servicing of the printer mechanism. In addition, sufficient residual toner may remain to allow an image from the last copy to be read from the belt. When sensitive documents are being copied, another individual can obtain information from those sensitive documents by inspecting the belt following completion of the copying process. Therefore, it is important that the belt be properly cleaned not only for cleanliness, but also for confidentiality.

The invention being claimed is:

1. An electrophotographic copying method for an apparatus having a photoreceptor with at least two image areas, the steps of the method comprise:

(a) selecting an initial image area to use for copying;
(b) electrostatically charging the selected image area;
(c) then exposing the selected image area to a light image thereby producing an electrostatic charge replica of the light image in the selected image area;
(d) thereafter applying toner to the selected image area of the photoreceptor;
(e) transferring the toner applied to the selected image area onto a medium and fusing the toner to the medium; and
(f) when another copy is to be made of the same light image at the completion of step (e), removing residual toner from the selected image area while electrostatically charging the other image area, thereafter selecting the other image area and repeating steps (b) through (e).

2. The method as recited in claim 1 further comprising removing residual toner from the selected image area, when an another copy is not desired at the completion of step (e).

3. A method for operating an electrophotographic copier which includes a charging device, a developing device, an image transfer device, a cleaning device, and a photoreceptor having a surface with first and second image areas, the steps of the method comprising:

(a) activating the charging device to apply an electrostatic charge to the photoreceptor as the first image area moves past the charging device;
(b) exposing the charged first image area to a light image thereby producing an electrostatic image;
(c) activating the developing device to apply toner to the photoreceptor as the first image area moves past the developing device;
(d) continuing to move the first image area past the image transfer device which now is activated to transfer the toner onto paper, and then fusing the toner to the paper; and
(e) if an another copy is to be made at the completion of step (d), moving the second image area past the charging device which now is activated to apply an electrostatic charge to the photoreceptor while moving the first image area past the cleaning device to remove toner from the photoreceptor, and thereafter repeating steps (b) through (d) with respect to the second image area instead of the first image area; otherwise moving the first image area past the cleaning device to remove toner from the photoreceptor.

4. The method as recited in claim 3 wherein movement of the photoreceptor is stopped during the exposing step.

5. The method as recited in claim 3 wherein the photoreceptor moves continuously throughout the method except during exposing step at which time the movement is stopped.

6. The method as recited in claim 3 wherein:

the image transfer device and the charging device are combined in a transfer/charge section in which the charging device is active during step (a) but not during step (d), and in which the image transfer device is active only during step (d); and the developing device and the cleaning device are combined in a developer/cleaner section in which the developing device is active only during step (c)

7. An electrophotographic copying method for an apparatus having a photoreceptor with separate first and second image areas, the steps of a copying operation comprise:

(a) electrostatically charging the first image area;
(b) exposing the charged first image area to a light image thereby producing an electrostatic charge replica of the light image in the first image area;
(c) then applying toner to the first image area of the photoreceptor;
(d) transfering the toner applied to the first image area onto paper and fusing the toner to the paper;
(e) thereafter removing residual toner from the first image area, while charging the second image area with a uniform charge;
(f) exposing the charged second image area to another light image thereby producing an electrostatic charge replica of the other light image in the second image area;
(g) then applying toner to the second image area of the photoreceptor;
(h) transfering the toner applied to the second image area onto paper and fusing the toner to the paper; and
(i) if an additional copy is desired, charging the first image area with a uniform charge while removing residual toner from the second image area, and then repeating at least steps (b) through (d).

8. The method as recited in claim 7 further comprising, at the completion of the copying operation, removing residual toner from the last image used to transfer toner onto paper.

* * * * *